US005445673A

United States Patent [19]

Bernert

[11] Patent Number: 5,445,673

[45] Date of Patent: Aug. 29, 1995

[54] DOSING SYSTEM

[75] Inventor: Richard Bernert, Giengen, Germany

[73] Assignee: J.M. Voith GmbH, Heidenheim, Germany

[21] Appl. No.: 273,030

[22] Filed: Jul. 8, 1994

[30] Foreign Application Priority Data

Jul. 10, 1993 [DE] Germany ..... 43 23 166.7
Aug. 16, 1993 [DE] Germany ..... 43 27 544.3

[51] Int. Cl.[6] ..... B05C 11/02

[52] U.S. Cl. ..... 118/123; 118/104; 118/203; 118/261; 118/413

[58] Field of Search ..... 118/123, 126, 70, 104, 118/119, 203, 261, 413; 162/281; 15/256.5, 256.51, 256.52; 101/365, 157, 169; 427/359, 361

[56] References Cited

U.S. PATENT DOCUMENTS 3,859,690 1/1975 Brown ..... 15/256.51
4,839,201 6/1989 Rantanen et al. ..... 118/413
4,889,073 12/1989 Meinander ..... 118/413
5,192,591 3/1993 Chance ..... 118/413

FOREIGN PATENT DOCUMENTS 2150907 4/1973 Germany .
2150906 12/1973 Germany .
3236991 4/1984 Germany .
3523449 1/1986 Germany .
2078140 1/1982 United Kingdom .

*Primary Examiner*—W. Gary Jones
*Assistant Examiner*—Laura E. Edwards
*Attorney, Agent, or Firm*—Baker & Daniels

[57] ABSTRACT

A dosing system with a doctor element fashioned as a doctor rod, for the coating of material webs which are passed over at least one roll coordinated with the doctor element. The doctor element is accommodated in a bed supported by a holder of integral design with the bed and held on the wall of a mounting which at the same time is a bounding wall of the mouth channel for the coating mixture. The holder features on its end on its side opposite the mounting wall a clamping or mounting surface. The holder possesses in the end area of the mounting wall bounding on the feed channel a jump in thickness. On its side opposite the said clamping or mounting surface, a protuberance is provided with a bevel which with the bounding wall of the holder contained on the side opposite the clamping or mounting surface forms an angle between 15° and 55°, which bounding wall surface is flush with the surface of the mounting wall.

7 Claims, 1 Drawing Sheet

DOSING SYSTEM

BACKGROUND OF THE INVENTION

The invention concerns a dosing system with a doctor element fashioned as a doctor rod, for the coating of material webs which are passed over at least one roll which is coordinated with the doctor element. The doctor element is accommodated in a bed supported by a holder. The holder is held on a wall of a mounting, which wall forms at the same time a bounding wall of a mouth channel for the coating mixture. The holder features on its end in on its side opposite the mounting wall a clamping or mounting surface. Such dosing systems are primarily used for the coating of webs of paper or cardboard.

Roll doctor rods are frequently used for the coating or dosing of coating mixture onto webs of paper or cardboard (refer, e.g., to DE 21 50 906). A roll carrying the paper web is generally coordinated with the doctor rod. Provisions often also are made such that the coating mixture serving the coating is fed from a chamber through a mouth whose bounding wall is the mounting wall on which the holder of the doctor bed accommodating the roll doctor rod is fixed.

In the flow path of the coating mixture from the mouth to the roll and roll doctor rod there are generally edges or cross-sectional changes of the flow channel created which may have an unfavorable effect on the coating. Such step is created notably also at the transition between said mounting wall and the holder of the doctor bed. The problem underlying the invention is to fashion the dosing system in such a way that minimally few edges and jumps, i.e., corresponding cross-sectional expansions or constrictions, occur in the flow path.

SUMMARY OF THE INVENTION

This problem is inventionally solved through the features of the present invention. In the present invention, the holder, in the area of the mounting wall which bounds on the feed channel, features a jump in thickness. On its side opposite the said clamping or mounting surface is a protuberance whose side away from the clamping or mounting surface of the holder is flush with the respective side bounding surface of the holder, and with the respective side bounding surface of the mounting wall. The solution pursuant to the invention makes it possible to perform the adjustment motion of the doctor holder without appreciable impediment and to generate at least on the side of the doctor holder a smooth flow path.

BRIEF DESCRIPTION OF THE DRAWINGS

The invention will hereafter be illustrated with the aid of the attached figures.

DETAILED DESCRIPTION OF THE INVENTION

Figure 1:
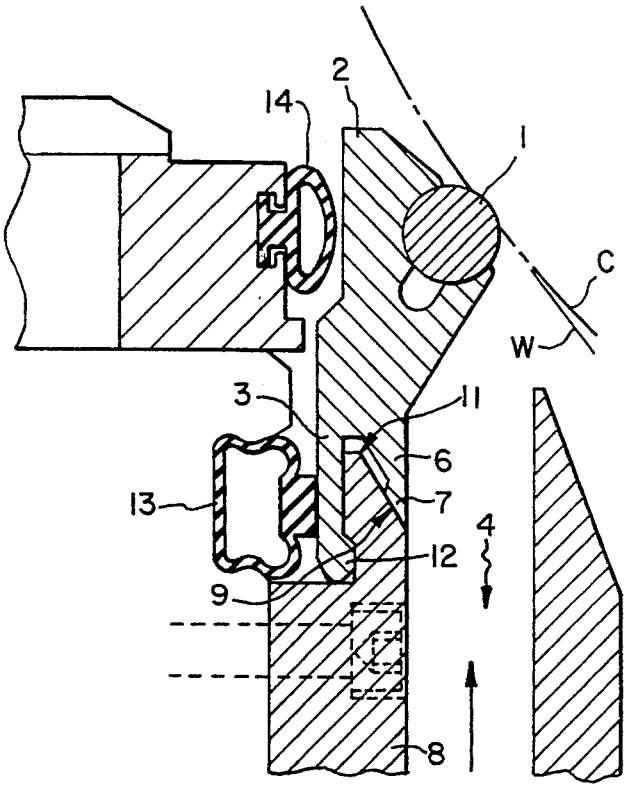
FIG. 1 shows a cross section of an embodiment of the dosing system of the present invention.

In FIG. 1, the doctor element comprises rod 1. The bed accommodating the doctor element, generally made of plastic material, is referenced 2. The holder, generally integral with the bed, is referenced 3. The roll doctor rod 1 bears generally on a backing roll C which carries the web W. The coating mixture passes either directly to the web or, to begin with, only to the roll C and later is transferred on the web in an area where the web wraps around the roll or touches it. The latter is generally the case when a squeeze gap is formed between two web-carrying rolls and the coating mixture is transferred on the web at that point.

The coating mixture is fed through the channel 4, which on one side is bounded by a mounting wall 8 onto which the holder 3 is pressed down by means of a hydraulically or pneumatically operating compression element 13—generally fashioned as a pressure hose. A projection 12 of the holder 3 serves as fixing provision. The holder 3 now has a heavy jump in the end area of the mounting wall 8, forming a protuberance 6 of the holder, which latter features a bevel bearing on a matching bevel 9 on the front of mounting wall 8. The angle inscribed by the bevel of protuberance 6 with the matching side wall surface of holder 3 ranges between 15° and 55°. Pursuant to FIG. 1, the protuberance virtually is formed by a point 7, so that a smooth transition is obtained between the mounting wall 8 and the holder 3, with the result of a relatively low-loss flow out of the channel 4.

To allow free movability of the holder 3, a fillet 11 is provided at the transition between the protuberance 6 and the end of the holder. This movability is necessary for the doctor bed, and thus the doctor rod, to be pushed toward the roll C. This is generally effected also by a pneumatic pressure hose 14.

Figure 2:
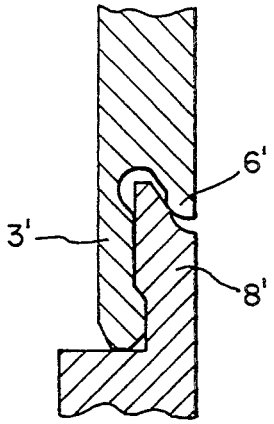
FIGS. 2–5 show alternative embodiments of the dosing system in cross section.

The arrangement in FIG. 2 is similar with a similar protuberance 6' which, however, does not extend into a point, but is rounded. A very minimal gap may exist between an appropriate fillet of the mounting wall 8'. The conditions of flow are favored hereby as well, and the free movability of the holder 3' is given to the required extent.

Figure 3:
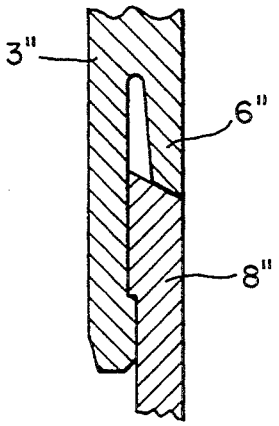

FIG. 3 illustrates a variant in which the protuberance 6'' of the holder 3'' is fashioned relatively long and slender. In this case, too, its side bounding surface away from the mounting part of the holder 3'' is flush with the corresponding side bounding surface of the mounting 8''. Here, the angle of the bevel of mounting and protuberance, about 70°, is relatively large and therefore, as such, not as favorable as a smaller angle. Namely, it is favorable for the protuberance to be allowed to slide relatively easily on the appropriate wall of the mounting 8'' in case of holder 3'' flexure.

Figure 4:
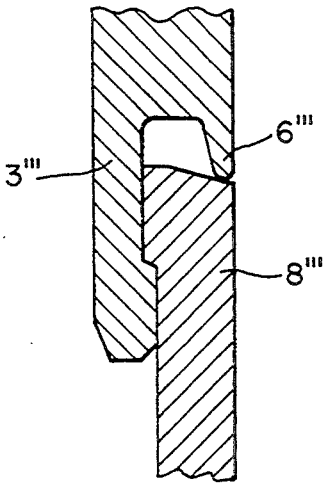

FIG. 4 depicts a relatively short protuberance 6''' of the holder 3'''. It ends in a small, rounded point and bears with it on the respective backing surface of the mounting 8'''.

Figure 5:
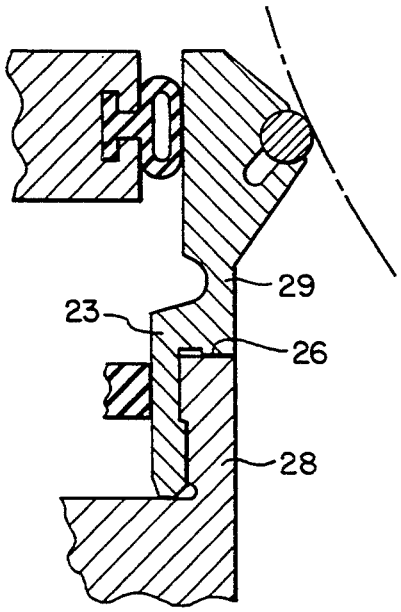

With the arrangement shown in FIG. 5, a different avenue has been chosen in fashioning the protuberance and creating the smooth flow channel up to the doctor bed. Here, the holder 23 features at 29 a further heavy jump and forms on this relatively weakened point, which is given a relatively small cross section, a pivoting point for the doctor bed, while the projection 26 bears on the mounting wall 28 of the doctor holder. The latter is arranged approximately perpendicularly to the wall swept by the coating mixture in accordance with the arrow shown. Here, the mounting wall bevel of other figures is no longer present. This—the same as a bevel with insufficient inclination, i.e., angles larger than 55°—is unfavorable in case the doctor bed including holder is substituted by a doctor blade. The extension of the channel up to the material web or backing roll, and the coating edge of the doctor element is then fluidically no longer as favorable.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dosing system for applying coating mixture to material webs which are passed over at least one roll, comprising:

a doctor element coordinated with the roll;

a bed supporting the doctor element;

a holder supporting the bed, said holder having two sides and having a bounding surface at one of said sides;

a mounting wall on which one side of the holder is held, said mounting wall being configured such that a portion of said mounting wall defines a bounding surface of a mouth channel for the coating mixture;

the other side of said holder being disposed opposite the mounting wall, and including on an end of said other side a clamping or mounting surface, said one side of the holder being configured such that a protuberance is formed on said one side thereof, said protuberance having two surfaces, one of said surfaces being generally flush with said holder bounding surface and said mounting wall bounding surface.

2. The dosing system of claim 1, wherein said protuberance includes a bevel which together with the bounding surface of the holder contained on the side opposite the clamping or mounting surface forms an angle between 15° and 55°.

3. The dosing system of claim 2, wherein an end of the mounting wall facing toward the protuberance engages the bevel of the latter and includes an inclined portion, said inclined portion being structured so that the beveled wall of the protuberance bears wholly on the mounting wall.

4. The dosing system of claim 1, wherein the protuberance of the holder is configured to include an upper portion having a greater thickness and a lower portion having a lesser thickness, said lower portion including a pointed portion.

5. The dosing system of claim 1, wherein a fillet is provided at a transition between the protuberance and the holder side adjacent to the clamping or mounting surface.

6. The dosing system of claim 1, wherein the holder is integral with the bed.

7. The dosing system of claim 1, wherein said doctor element comprises a doctor rod.

* * * * *